US010825415B2

(12) United States Patent
Tsai et al.

(10) Patent No.: US 10,825,415 B2
(45) Date of Patent: Nov. 3, 2020

(54) TIME CONTROLLER AND LIQUID CRYSTAL DISPLAY APPARATUS THEREOF

(71) Applicant: Fitipower Integrated Technology (Shenzhen) Inc., Shenzhen (CN)

(72) Inventors: Fu-Chuan Tsai, Hsinchu (TW); Yu-Chun Tsai, Hsinchu (TW); Chang Zhu, Shenzhen (CN); Hong-Yun Wei, Shenzhen (CN); Xiao-Jun Chen, Shenzhen (CN)

(73) Assignee: Fitipower Integrated (Shenzhen) Inc., Shenzhen (CN)

( * ) Notice: Subject to any disclaimer, the term of this patent is extended or adjusted under 35 U.S.C. 154(b) by 0 days.

(21) Appl. No.: 16/239,767

(22) Filed: Jan. 4, 2019

(65) Prior Publication Data

US 2020/0126503 A1 Apr. 23, 2020

(30) Foreign Application Priority Data

Oct. 23, 2018 (CN) ..... 2018 1 1238658

(51) Int. Cl.
*G09G 3/36* (2006.01)

(52) U.S. Cl.
CPC ..... *G09G 3/3688* (2013.01); *G09G 3/3607* (2013.01); *G09G 2310/027* (2013.01); *G09G 2310/08* (2013.01); *G09G 2320/064* (2013.01); *G09G 2320/0673* (2013.01)

(58) Field of Classification Search
CPC ..... G09G 3/3688; G09G 3/3607; G09G 2310/027; G09G 2310/08; G09G 2320/064; G09G 2320/0673
See application file for complete search history.

(56) References Cited

U.S. PATENT DOCUMENTS 9,230,511 B2 * 1/2016 Jeon ..... G09G 5/10
2008/0100601 A1 * 5/2008 Moon ..... G09G 3/3648 345/204

* cited by examiner

*Primary Examiner* — Stacy Khoo
(74) *Attorney, Agent, or Firm* — ScienBiziP, P.C.

(57) ABSTRACT

A time controller is able to convert and present the LCD display of gray levels within images with a brightness equal to that within the original images. The time controller alternates in operation between first and second modes of gamma correction, each for a specified time duration. In the first correction mode, the time controller corrects the original gray levels in a correction-positive manner and outputs first correction gray levels. In the second correction mode, the time controller corrects the original gray levels in a correction-negative manner, and outputs the second correction gray levels. The first correction gray level is equal to or larger than the second correction gray level, to correspond with original gray levels.

14 Claims, 6 Drawing Sheets

TIME CONTROLLER AND LIQUID CRYSTAL DISPLAY APPARATUS THEREOF

FIELD

The present disclosure relates to liquid crystal displays.

BACKGROUND

Generally, liquid crystal displays (LCDs) include an LCD panel, a time controller, and a data driver. The time controller receives image data and driving signals, and converts the image data into gray levels. The time controller outputs the gray levels to the data driver based on the driving signals. The data driver converts the gray levels into data voltages for images to appear on the LCD panel based on the signals received. The liquid crystals in the LCD panel may effects the brightness of the LCD, such that the LCD does not show the specified brightness. Further, when viewed from certain angles there may also be color washout. A gamma correction provided for improving the above issues may not function effectively.

Thus, there is room for improvement in the art.

BRIEF DESCRIPTION OF THE FIGURES

Implementations of the present disclosure will now be described, by way of example only, with reference to the attached figures.

DETAILED DESCRIPTION

Figure 1:
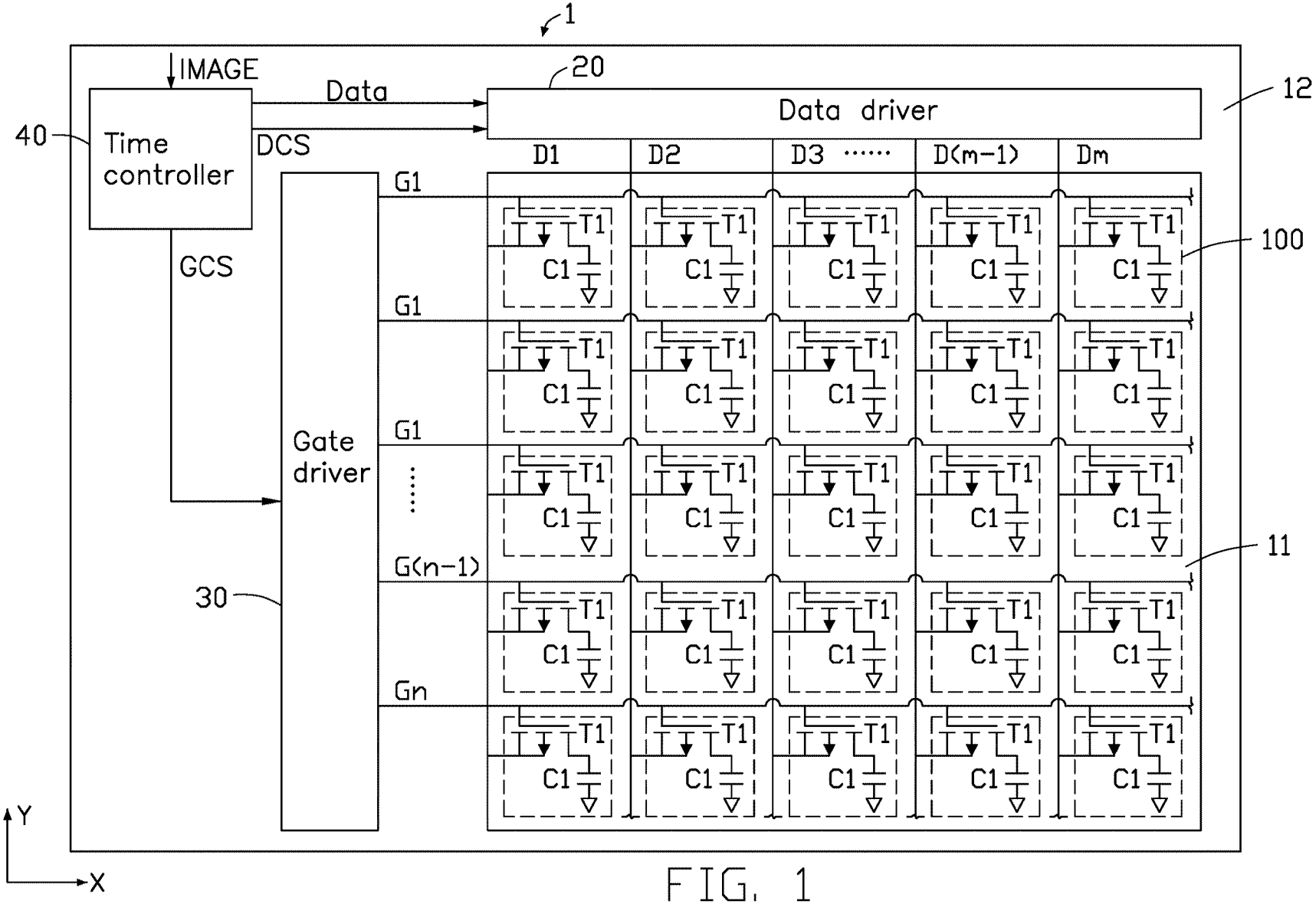
FIG. 1 is a diagram showing an embodiment of a liquid crystal display apparatus, the liquid crystal display apparatus includes a time controller and pixel units.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

The term "comprising" means "including, but not necessarily limited to"; it specifically indicates open-ended inclusion or membership in a so-described combination, group, series, and the like. The disclosure is illustrated by way of example and not by way of limitation in the figures of the accompanying drawings in which like references indicate similar elements. It should be noted that references to "an" or "one" embodiment in this disclosure are not necessarily to the same embodiment, and such references can mean "at least one."

The present disclosure provides a liquid crystal display apparatus with the time controller.

FIG. 1 shows a liquid crystal display apparatus 1. In one embodiment, the liquid crystal display apparatus 1 can be a Twisted Nematic (TN) type, a In-Plane Switching (IPS) type, an Optically Compensated Birefringence (OCB) type, a Vertical Alignment (VA) type, or a cured type liquid crystal display apparatus, but is not being limited by the examples provided herein.

The liquid crystal display apparatus 1 defines a display region 11 and a non-display region 12 surrounding the display region 11. A plurality of scan lines G1-Gn and a plurality of data lines D1-Dm are disposed in the display region 11. The scan lines G1-Gn are parallel along a first direction X, and the data lines D1-Dm are parallel along a second direction Y, Y being perpendicular to X. The scan lines G1-Gn and the data lines D1-Dm are arranged as a grid to define pixel units 100 at each line crossing. A particular design of a display device can cross scan lines G1-Gn over data lines D1-Dm at a different angle, the orientations of the lines are not limited to such orientation. Each pixel unit 100 includes at least one transistor T1, a pixel electrode (not shown), a common electrode (not shown), and a liquid crystal layer (not shown) located between the pixel electrode and the common electrode. The pixel electrode and the common electrode cooperate with each other to form a storing capacitor C1. In other embodiments, the pixel unit 100 can further include an external capacitor connected in parallel with the storing capacitor C1. Different voltages applied on the pixel electrode and the common electrode cause liquid crystals in the liquid crystal layer to rotate to different extents, thereby a brightness of the liquid crystal display apparatus 1 is adjustable.

A data driver 20, a gate driver 30, and a time controller 40 are disposed in the non-display region 12. In one embodiment, the data driver 20, the gate driver 30, and the time controller 40 are bonded on the liquid crystal display panel (not shown) of the liquid crystal display apparatus 1 in a tape-automated bonding (TAB) manner, in a chip on glass (COG) manner, or in a gate in panel (GIP) manner. In another embodiment, the data driver 20, the gate driver 30, and the time controller 40 can be directly integrated on the liquid crystal display panel of the liquid crystal display apparatus 1.

Each pixel unit 100 is electrically connected to the gate driver 30 through a specified scan line Gi, and is electrically connected to the data driver 20 through a specified data line Di.

The time controller 40 generates gate control signals GCS to the gate driver 30 and data control signals DCS to the data driver 20 based on driving signals received. The time controller 40 also receives image data (IMAGE), converts the received IMAGE into gray levels matching the original gray levels, and corrects the original gray levels before outputting to the data driver 20. In one embodiment, the time controller 40 also generates other control signals. The other control signals may include a vertical synchronization (Vsync) signal, a horizontal synchronization (Hsync) signal, clock signal CLK, and a data enable (DE) signal, but are not limited thereto.

The time controller 40 corrects and outputs the corrected gray levels to the data driver 20. The time controller 40 alternately operates under a first correction mode P and a second correction mode N, each for a specified time duration. In the first correction mode P, the time controller 40 corrects the original gray levels in a correction-positive manner, and outputs first correction gray levels. In the second correction mode N, the time controller 40 corrects the original gray levels in a correction-negative manner, and outputs second correction gray levels. For one pixel unit 100, the first correction gray level in the first correction mode P is larger than or equal to the second correction gray level in the second correction mode N. The first correction mode P corresponds to a first correction curve L1, and the second correction mode N corresponds to a second correction curve L2. In one embodiment, the specified time duration can be one display frame. In other embodiments, the specified time duration can be two, three, four, or more display frames, not being limited thereto.

Figure 2:
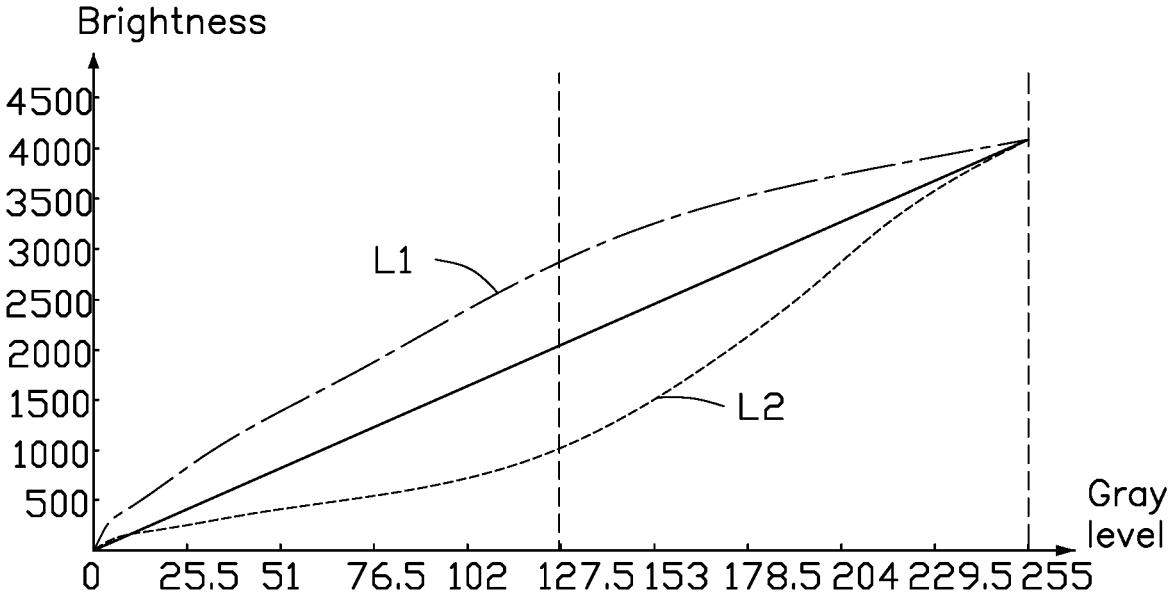
FIG. 2 is a diagram showing a first correction curve and a second correction curve of the time controller of FIG. 1.

As shown in FIG. 2, X axis represents the gray level, and Y axis represents a brightness. There are 256 gray levels, which are from 0 to 255. As the first correction curve L1 and the second correction curve L2 show, a difference between the brightness of the first correction gray level and the brightness of the original gray level gradually reduces along a direction from a specified center gray level to either a first or a last gray level. For example, a difference between the brightness of the first correction gray level at 0 and the brightness of the original gray level at 0 is less than the difference between the brightness of the first correction gray level at 127.5 and the brightness of the original gray level at 127.5. The difference between the brightness of the first correction gray level at 255 and the brightness of the original gray level at 255 is less than the difference between the brightness of the second correction gray level at 127.5 and the original gray level at 127.5. In one embodiment, the first correction curve L1 is not symmetrical arranged with the second correction curve L2. For the same original gray level, the difference between the brightness of the first correction gray level and the brightness of the original gray level according to the first correction curve L1 is different from the difference between the brightness of the second correction gray level and the brightness of the original gray level according the second correction curve L2. In other embodiments, the first correction curve L1 is symmetrical arranged with the second correction curve L2. For the same original gray level, the difference between the brightness of the correction gray level and the brightness of the original gray level on the first correction curve L1 is equal to the difference between the brightness of the correction gray level and the brightness of the original gray level on the second correction curve L2.

Figure 3:
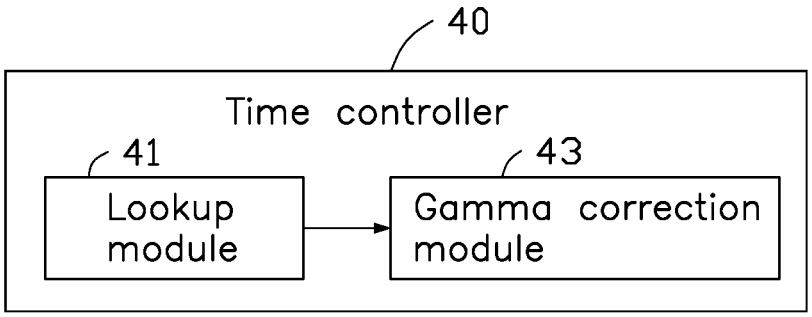
FIG. 3 is a diagram showing a first embodiment of the time controller of FIG. 1.

FIG. 3 illustrates a first embodiment of the time controller 40. The time controller 40 includes a lookup module 41 and a gamma correction module 43.

The lookup module 41 stores a first lookup table and a second lookup table. The first lookup table stores a relationship between the original gray levels and correction values in the first correction mode P. The second lookup table stores a relationship between the original gray levels and the correction values in the second correction mode N. The lookup module 41 obtains the correction value from the first lookup table or from the second lookup table based on the original gray level. For the same original gray level, the correction value in the first lookup table is larger than or equal to the correction value in the second lookup table. For example, for original gray level at 126, the correction value in the first lookup table is +15, thus the first correction gray level is a sum of the original gray level and the correction value, which is 141. The correction value in the second lookup table is −14, thus the second correction gray level is a sum of the original gray level and the correction value, which is 112. For the original gray level at 5, the correction value in the first lookup table is +8, thus the first correction gray level is a sum of the original gray level and the correction value of 13. The correction value in the second lookup table is +3, thus the second correction gray level is a sum of the original gray level and the correction value of 8. In one embodiment, the correction values in the first lookup table and the second lookup table are integers, which can be positive values, negative values or zeros, and these gradually increase to the original gray level.

The gamma correction module 43 alternates between the first correction mode P and the second correction mode N in the specified time duration. In detail, the gamma correction module 43 operates under one correction mode for the specified time duration, and then switches to operate under the other correction mode. The gamma correction module 43 switches over to the alternative after the specified time duration. For example, the gamma correction module 43 operates under the first correction model M for the specified time duration, and then switches to operate under the second correction mode P for the specified time duration, and then switches to operate under the first correction mode M for the specified time duration. In the first correction mode P, the gamma correction module 43 corrects the original gray levels based on the correction values from the first lookup table for correcting the original gray levels in the correction-positive manner, and outputs the first correction gray levels. In the second correction mode M, the gamma correction module 43 corrects the original gray levels based on the correction values from the second lookup table for correcting the original gray levels in the correction-negative manner, and outputs the second correction gray levels. The first correction gray level is larger than or equal to the second correction gray level, to correspond to a same original gray level. Each of the first correction gray level and the second correction gray level is a sum of the original gray level and a correction value.

Figure 4:
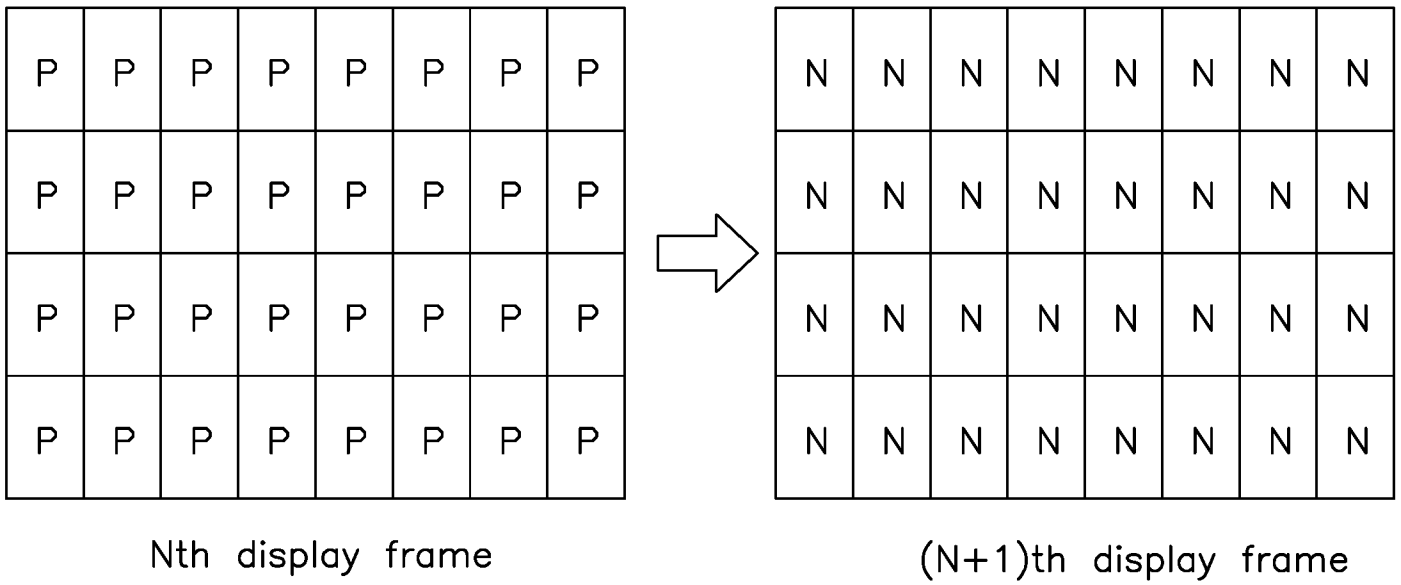
FIG. 4 is a diagram showing the pixel units in two adjacent display frames of FIG. 1.

FIG. 4 shows parts of the pixel unit 100 of the liquid crystal display apparatus 1 in two display frames. In one embodiment, there are 32 pixel units, arranged in a 4*8 matrix.

In an Nth display frame, the lookup module 41 obtains the correction value in the first lookup table, and the gamma correction module 43 that operates under the first correction mode P corrects the original gray levels based on the obtained correction values and outputs the first correction gray levels based on the original gray levels and the obtained correction values.

In an (N+1)th display frame, the lookup module 41 obtains the correction value in the second lookup table, and the gamma correction module 43 that operates under the second correction mode M corrects the original gray levels based on the obtained correction values and outputs the second correction gray levels based on the original gray levels and the obtained correction values.

The time controller alternates in the first correction mode P and in the second correction mode M in the specified time duration for correcting the original gray levels in different ways, color washout is improved. Thus, a performance of the liquid crystal display apparatus is improved and a moiré issue can also be improved.

Figure 5:
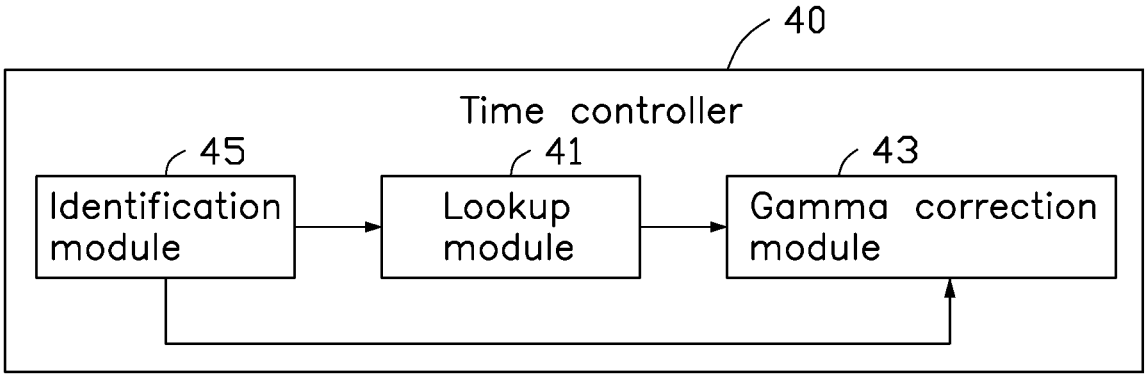
FIG. 5 is a diagram showing a second embodiment of the time controller of FIG. 1.

FIG. 5 shows the pixel units 100. The pixel units 100 comprise a plurality of first pixel units 100*a* and a plurality of second pixel units 100*b*. In one embodiment, the first pixel units 100*a* and the second pixel units 100*b* are alternately arranged along the first direction X, and alternately arranged along the second direction Y. Each second pixel unit 100*b* is inserted between two adjacent first pixel units 100*a*. In other embodiments, the first pixel units 100*a* and the second pixel units 100*b* are merely alternately arranged along the first direction X. Thus, a column of the first pixel units 100*a* is inserted between two adjacent columns of the second pixel units 100*b*. In other embodiments, the first pixel units 100*a* and the second pixel units 100*b* are merely alternately arranged along the second direction Y. Thus, a line of the first pixel units 100*a* is inserted between two adjacent lines of the second pixel units 100*b*. Each of the first pixel units 100*a* and the second pixel units 100*b* can include a first sub-pixel, a second sub-pixel, and a third sub-pixel. The first sub-pixels, the second sub-pixels, and the third sub-pixels emit light of different colors. The first sub-pixels can emit red light, the second sub-pixels can emit green light, and the third sub-pixel can emit blue light. In other embodiments, each of the first pixel units 100*a* and the second pixel units 100*b* can further include a fourth sub-pixel, and the fourth sub-pixel can emit white light.

The time controller 40 applies the first correction mode P and the second correction mode M for the first pixel units 100*a* and the second pixel units 100*b* in a specified time duration in a dot inversion manner, which means that the time controller 40 further corrects the first pixel units 100*a* under one of the first correction mode P and the second correction mode M, and corrects the second pixel units 100*b* under the other mode. The time controller 40 further corrects the first pixel units 100*a* under the other of the first correction mode P and the second correction mode M, and corrects the second pixel units 100*b* under the other mode in the specified time duration. In other words, the first pixel units 100*a* are corrected under the first correction mode P, and the second pixel units 100*b* are corrected under the second correction mode M for the specified time duration, then the first pixel units 100*a* are corrected under the second correction mode M, and the second pixel units 100*b* are corrected under the second correction mode P, thus completing one dot inversion.

The time controller 40 further includes an identification module 45. The identification module 45 identifies a relationship between the original gray levels and the first pixel unit 100*a* or the second pixel unit 100*b*, and generates the identification signal. When the original gray level corresponds to the first pixel unit 100*a*, the identification module 45 generates a first identification signal. When the original gray level corresponds to the second pixel unit 100*b*, the identification module 45 generates a second identification signal.

The gamma correction module 43 further corrects the original gray levels corresponding to the first pixel units 100*a* under one of the first correction mode P and the second correction mode M as a specified correction mode based on the first identification signals, obtains the correction values from the first lookup table or the second lookup table, corrects the original gray levels based on the obtained correction values, and outputs the first correction gray levels or the second correction gray levels. The gamma correction module 43 further corrects the original gray levels corresponding to the second pixel unit 100*b* under one of the first correction mode P and the second correction mode M as a specified correction mode based on the second identification signals, obtains the correction values from the first lookup table or the second lookup table, corrects the original gray levels based on the obtained correction values, and outputs the first correction gray levels or the second correction gray levels.

Figure 6:
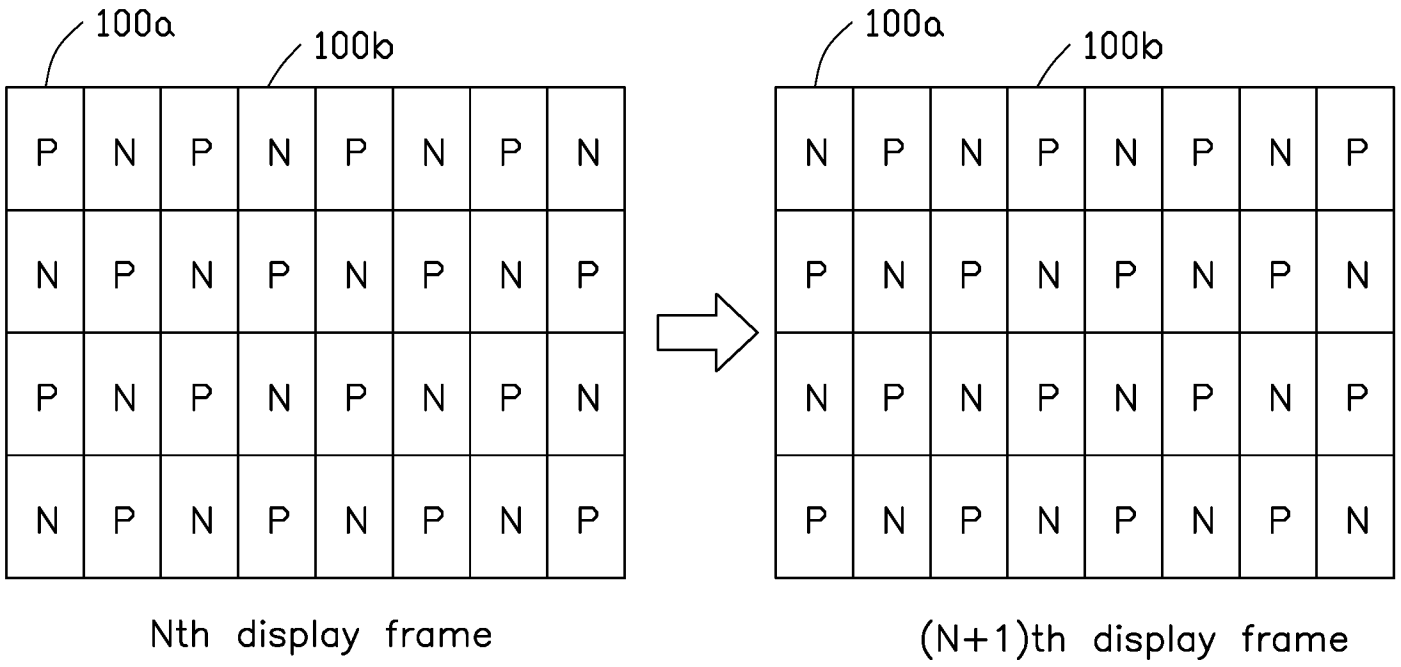
FIG. 6 is a diagram showing the pixel units in two adjacent display frames of FIG. 1.

FIG. 6 shows the first pixel units 100*a* and the second pixel units 100*b* in two adjacent display frames. In one embodiment, the liquid crystal display apparatus 1 includes 32 pixel units 100. There are 16 first pixel units 100*a* and 16 second pixel units 100*b*. The first pixel units 100*a* and the second pixel units 100*b* are arranged in a 4*8 matrix, and are alternately arranged along the first direction X and the second direction Y.

In an Nth display frame, the identification module 45 generates the first identification signals based on the original gray levels corresponding to the first pixel units 100*a*, and generates the second identification signals based on the original gray levels corresponding to the second pixel units 100*b*. The lookup table 41 obtains the correction values from the first lookup table based on the original gray levels corresponding to the first pixel units 100*a*. The gamma correction module 43 controls the original gray levels corresponding to the first pixel units 100*a* to be corrected under the first correction mode P in response to the first identification signals, corrects the original gray levels based on the obtained correction values from the first lookup table, and outputs the first correction gray levels based on the original gray levels and the obtained correction values from the first lookup table. The lookup module 41 obtains the correction values from the second lookup table based on the original gray levels corresponding to the second pixel units 100*b*. The gamma correction module 43 controls the original gray levels corresponding to the second pixel units 100*b* to be corrected under the second correction mode M in response to the second identification signals, corrects the original gray levels based on the obtained correction values from the second lookup table, and outputs the second correction gray levels based on the original gray levels and the obtained correction values from the second lookup table.

In an (N+1)th display frame, the lookup module 41 obtains the correction values from the second lookup table based on the original gray levels corresponding to the first pixel units 100*a*. The gamma correction module 43 controls the original gray levels corresponding to the first pixel units 100*a* to be corrected under the second correction mode M, corrects the original gray levels based on the obtained correction values from the second lookup table, and outputs the second correction gray levels based on the original gray levels and the obtained correction values from the second lookup table. The lookup module 41 obtains the correction values from the first lookup table based on the original gray levels corresponding to the second pixel units 100*b*. The gamma correction module 43 controls the original gray levels corresponding to the second pixel units 100*b* to correct under the first correction mode P, corrects the original gray levels based on the obtained correction values from the first lookup table, and outputs the first correction gray levels based on the original gray levels and the obtained correction values from the first lookup table.

Thus, during the display of odd frames, the first pixel units 100*a* are corrected in the first correction mode P, and the second pixel units 100*b* are corrected in the second correction mode M. During the display of even frames, the first pixel units 100*a* are corrected in the second correction mode M, and the second pixel units 100*b* are corrected in the first correction mode P, thus the operation mode of the pixel units 100 of the liquid crystal display apparatus 1 are inverted in a dot inversion manner.

The first correction mode P and the second correction mode M are alternately used for correcting the original gray levels in two different ways, thus color washout is improved, and performance of the display panel is improved. Further, two adjacent pixel units 100 are corrected in different modes, and interchange the operation mode in the specified time duration. Thus, a moiré issue can be improved.

While various and preferred embodiments have been described the disclosure is not limited thereto. On the contrary, various modifications and similar arrangements (as would be apparent to those skilled in the art) are also intended to be covered. Therefore, the scope of the appended claims should be accorded the broadest interpretation so as to encompass all such modifications and similar arrangements.

What is claimed is:

1. A time controller receiving image data, converting the received image data into gray levels as original gray levels;

wherein the time controller operates under a first correction mode and a second correction mode; the time controller operates under the first correction mode and the second correction mode for a specified time duration; in the first correction mode, the time controller corrects the original gray levels in a correction-positive manner, and outputs first correction gray levels; in the second correction mode, the time controller corrects the original gray levels in a correction-negative manner, and outputs second correction gray levels; the first correction gray level is larger than or equal to the second correction gray level corresponding to a same original gray level; the original gray levels are applied to pixel units for controlling the pixel units to display an image; the pixel units comprise a plurality of first pixel units and a plurality of second pixel units; the plurality of the first pixel units and the plurality of the second pixel units are alternately arranged along a first direction, and further alternately arranged along a second direction perpendicular to the first direction; when each first pixel unit operates under either the first correction mode or the second correction mode, and each second pixel unit operates under the other one of either the first correction mode or the second correction mode; the time controller exchanges the first and second correction mode for the plurality of first pixel units and the plurality of the second pixel units in the specified time duration in a dot inversion manner.

2. The time controller of claim 1, wherein the time controller stores a first lookup table and a second lookup table; each of the first lookup table and the second lookup table stores a relationship between correction values and the original gray levels; the time controller further obtains corresponding correction values from the first lookup table or the second lookup table; in the first correction mode, the time controller corrects the original gray levels based on the original gray levels and the corresponding correction values from the first table for correcting in the correction-positive manner; in the second correction mode, the time controller corrects the original gray levels based on the original gray levels and the corresponding correction values from the second lookup table for correcting in the correction-negative manner.

3. The time controller of claim 2, wherein the time controller further identifies a relationship between the original gray levels and first pixel units, and a relationship between the original gray levels and second pixel units; when the original gray level corresponds to the first pixel unit, the time controller further generates a first identification signal to control the corresponding first pixel unit to operate under one of the first correction mode and the second correction mode, when the original gray level corresponds to the second pixel unit, the time controller further generates a second identification signal to control the corresponding second pixel unit to operate under the other of the first correction mode and the second correction mode.

4. The time controller of claim 2, wherein each first correction gray level is a sum of the original gray level and the corresponding correction value, and each second correction gray level is a sum of the original gray level and the corresponding correction value.

5. The time controller of claim 2, wherein each correction value in the first lookup table corresponding to an original gray level is larger than or equal to a correction value in the second lookup table corresponding to the same original gray level.

6. The time controller of claim 1, wherein the first correction mode corresponds to a first correction curve; the second correction mode corresponds to a second correction curve; in the first correction curve and the second correction curve, a brightness difference between the first correction gray level and the original gray level gradually decreases along a direction from a middle gray level to one of a first gray level and a last gray level.

7. The time controller of claim 1, wherein the specified time duration is one display frame.

8. A liquid crystal display apparatus comprising:

a plurality of scan lines parallel to each other;

a plurality of data lines crossed with the plurality of scan lines to define a plurality of pixel units arranged in a matrix;

a data driver electrically connected to the pixel units through the plurality of the data lines;

a gate driver electrically connected to the pixel units through the plurality of the scan lines; and a time controller electrically connected to the data driver and the gate driver, and configured to receive image data;

wherein the time controller converts the image data into gray levels as original gray levels; the time controller alternately operates under a first correction mode and a second correction mode, each for a specified time duration; the time controller operates under one of the first correction mode and the second correction mode for the specified time duration, and then switches to operate under the other of the first correction mode and the second correction mode; in the first correction mode, the time controller corrects the original gray levels in a correction-positive manner, and outputs first correction gray levels; in the second correction mode, the time controller corrects the original gray levels in a correction-negative manner, and outputs second correction gray levels; one of the first correction gray levels corresponding to the original gray level is larger than or equal to one of the second correction gray levels corresponding to a same original gray level; the original gray levels are applied to pixel units for controlling the pixel unit to display an image; the pixel units comprises a plurality of first pixel units and a plurality of second pixel units; the plurality of the first pixel units and the plurality of the second pixel units are alternately arranged along a first direction, and further alternately arranged along a second direction perpendicular to the first direction; the time controller exchanges first and second correction modes for the plurality of first pixel units and the plurality of the second pixel units in the specified time duration in a dot inversion manner; either the first correction mode or the second correction mode is used for correcting the original gray levels corresponding to the plurality of the first pixel units, and the other one of either the first correction mode or the second correction mode is used for correcting the original gray levels corresponding to the plurality of the second pixel units.

9. The liquid crystal display apparatus of claim 8, wherein the time controller stores a first lookup table and a second lookup table; each of the first lookup table and the second lookup table stores a relationship between correction values and the original gray levels; the time controller obtains corresponding correction values from the first lookup table or the second lookup table in the first correction mode, the time controller corrects the original gray levels based on the original gray levels and the corresponding correction values from the first table for correcting in the correction-positive manner; in the second correction mode, the time controller corrects the original gray levels based on the original gray levels and the corresponding correction values from the second lookup table for correcting in the correction-negative manner.

10. The liquid crystal display apparatus of claim 9, wherein the time controller further identifies a relationship between the original gray levels and first pixel units, and a relationship between the original gray levels and second pixel units; when the original gray level corresponds to the first pixel unit, the time controller further generates a first identification signal to control the corresponding first pixel unit to operate under one of the first correction mode and the second correction mode, when the original gray level corresponds to the second pixel unit, the time controller further generates a second identification signal to control the corresponding second pixel unit to operate under the other one of the first correction mode and the second correction mode.

11. The liquid crystal display apparatus of claim 9, wherein each first correction gray level and second correction gray level is a sum of the original gray level and the corresponding correction value, and each second correction gray level is a sum of the original gray level and the corresponding correction value.

12. The liquid crystal display apparatus of claim 9, wherein each correction value in the first lookup table corresponding to an original gray level is larger than or equal to a corresponding correction value in the second lookup table corresponding to the same original gray level.

13. The liquid crystal display apparatus of claim 8, wherein the first correction mode corresponds to a first correction curve; the second correction mode corresponds to a second correction curve; in the first correction curve and the second correction curve, a brightness difference between the first correction gray level and the original gray level gradually decreases along a direction from a middle gray level to one of a first gray level and a last gray level.

14. The liquid crystal display apparatus of claim 8, wherein the specified time duration is one display frame.

* * * * *